US006505023B2

(12) United States Patent
Miyamoto

(10) Patent No.: US 6,505,023 B2
(45) Date of Patent: Jan. 7, 2003

(54) COLOR IMAGE FORMING APPARATUS AND METHOD

(75) Inventor: Takahito Miyamoto, Osaka (JP)

(73) Assignee: Minolta Co., Ltd., Osaka (JP)

( * ) Notice: Subject to any disclaimer, the term of this patent is extended or adjusted under 35 U.S.C. 154(b) by 0 days.

(21) Appl. No.: 09/802,945

(22) Filed: Mar. 12, 2001

(65) Prior Publication Data

US 2001/0009623 A1 Jul. 26, 2001

(51) Int. Cl.[7] ..... G03G 15/10
(52) U.S. Cl. ..... 399/237
(58) Field of Search ..... 399/159, 222, 399/233, 237, 223, 297, 298, 299; 106/31.13; 347/100; 428/195; 430/66, 83, 117, 119

(56) References Cited

U.S. PATENT DOCUMENTS 5,374,980 A * 12/1994 Kubo et al. ..... 399/233
6,027,852 A 2/2000 Sasaki et al. ..... 430/270.1
6,050,676 A * 4/2000 Sugimoto et al. ..... 347/100 X
6,277,477 B1 * 8/2001 Tracy et al. ..... 428/195

FOREIGN PATENT DOCUMENTS

| | | | |
|---|---|---|---|
| EP | 0 697 290 | | 2/1996 |
| JP | 406175441 | * | 6/1994 |
| JP | 9-131914 | | 5/1997 |

* cited by examiner

*Primary Examiner*—Hoan Tran
(74) *Attorney, Agent, or Firm*—McDermott, Will & Emery

(57) ABSTRACT

An image forming apparatus includes an image bearing member; a latent image forming device for forming first and second latent images on the image bearing member; a developing device for developing the first latent image with first ink to form a first ink image, and developing the second latent image with second ink to form a second ink image; and a transferring device which transfers the first ink image onto a transfer member and then the second ink image onto the transfer member. The surface tension of the first ink is set higher than that of the second ink.

20 Claims, 3 Drawing Sheets

COLOR IMAGE FORMING APPARATUS AND METHOD

BACKGROUND OF THE INVENTION

The present invention relates to a color image forming apparatus and method for forming a color image by repeating a process for a plurality of color inks. In particular, the present invention relates to a color image forming apparatus and method comprising the steps of forming a latent image on an image bearing member, then developing the latent image with a corresponding color ink to form a color image, and finally transferring the color image onto a transfer member such as recording medium or intermediate ink receptive blanket.

Recently, environmentally friendly water-based ink has received great attention as a coloring material used for an image forming device such as copy machine or printer.

Conventionally, various image forming methods using the water-based ink have been proposed. For example, EP 0 697 290 discloses a method in which aqueous printing ink is applied to a waterless printing plate having a hydrophobic non-image surface area and a hydrophilic image area. The image surface area is wetted by the ink while the ink is repelled from the non-image surface area. JP 09-131914 A discloses a method in which an ink image carrier body having a hydrophilic layer on which a water repellent liquid is formed. The water repellent liquid is then selectively resolved to form a latent image. U.S. Pat. No. 6,027,852 discloses a method in which a printing plate having a surface formed with a material such as photochromic compound. The contact angle of the surface with water is selectively changed by photo-irradiation to form a latent image.

However, in those image forming methods, since ink surface tension influences greatly the wetting of the ink onto an image bearing member such as printing plate, it is necessary to limit the surface tension value of the ink to be used. In addition, with a color image forming device, in which second ink is superimposed on first ink to form an image, the difference in the surface tension between the inks may create problems such as bleeding, trapping failure, or backtrapping. The "first ink" refers to the ink that is transferred onto a transfer member (such as recording medium or intermediate ink receptive blanket) firstly. The "second ink" refers to the ink that is transferred onto the transfer member onto which the first ink has been transferred.

Therefore, the object of the present invention is to provide a color image forming apparatus and method, allowing lower bleeding property, higher trapping property, and lower backtrapping property.

Herein, the term "bleeding property" is used to designate the degree to which the first ink and the second ink diffuse or mix into each other. The term "trapping property" is used to designate the degree to which the second ink is transferred onto the first ink. The term "backtrapping property" is used to designate the degree to which the first ink already on a transfer member is retransferred or offset onto an image bearing member bearing the second ink.

SUMMARY OF THE INVENTION

To achieve the above object, an image forming apparatus according to the present invention comprises an image bearing member; a latent image forming device for forming first and second latent images on the image bearing member; a developing device for developing the first latent image with first ink to form a first ink image, and developing the second latent image with second ink to form a second ink image; and a transferring device which transfers the first ink image onto a transfer member and then the second ink image onto said transfer member. The surface tension of the first ink is set higher than that of the second ink.

In another aspect of the image forming apparatus according to the present invention, the image bearing member includes a ferroelectric layer for forming a latent image therein.

In another aspect of the image forming apparatus according to the present invention, the first and second inks are water-based inks.

In another aspect of the image forming apparatus according to the present invention, the surface tension difference between the first and second inks is equal to or less than 15 dyne/cm.

An image forming method according to the present invention comprises the steps of forming first and second latent images; developing the first latent image with first ink to form a first ink image, and developing the second latent image with second ink to form a second ink image; and transferring the first ink image onto a transfer member and then the second ink image onto the transfer member. The surface tension of the first ink is set higher than that of the second ink.

In another aspect of the image forming method according to the present invention, the first and second inks are water-based inks.

In another aspect of the image forming method according to the present invention, the surface tension difference between the first and second inks is equal to or less than 15 dyne/cm.

Another image forming apparatus comprises first and second image forming units. The first image forming unit includes a first image bearing member; a first latent image forming device for forming a latent image on the first image bearing member; a first developing device for developing the latent image formed on the first image bearing member with first ink to form a first ink image; and a first transferring device for transferring the first ink image onto a transfer member. The second image forming unit includes a second image bearing member; a second latent image forming device for forming a latent image on the second image bearing member; a second developing device for developing the latent image formed on the second image bearing member with second ink to form a second ink image; and a second transferring device for transferring the second ink image onto the transfer member onto which the first ink image has been transferred. The surface tension of the first ink is set higher than that of the second ink.

In another aspect of the image forming apparatus according to the present invention, each of the first and second image bearing members includes a ferroelectric layer for forming a latent image therein.

In another aspect of the image forming apparatus according to the present invention, the first and second inks are water-based inks.

In another aspect of the image forming apparatus according to the present invention, the surface tension difference between the first and second inks is set equal to or less than 15 dyne/cm.

DETAILED DESCRIPTION OF THE PREFERRED EMBODIMENTS

Figure 1:
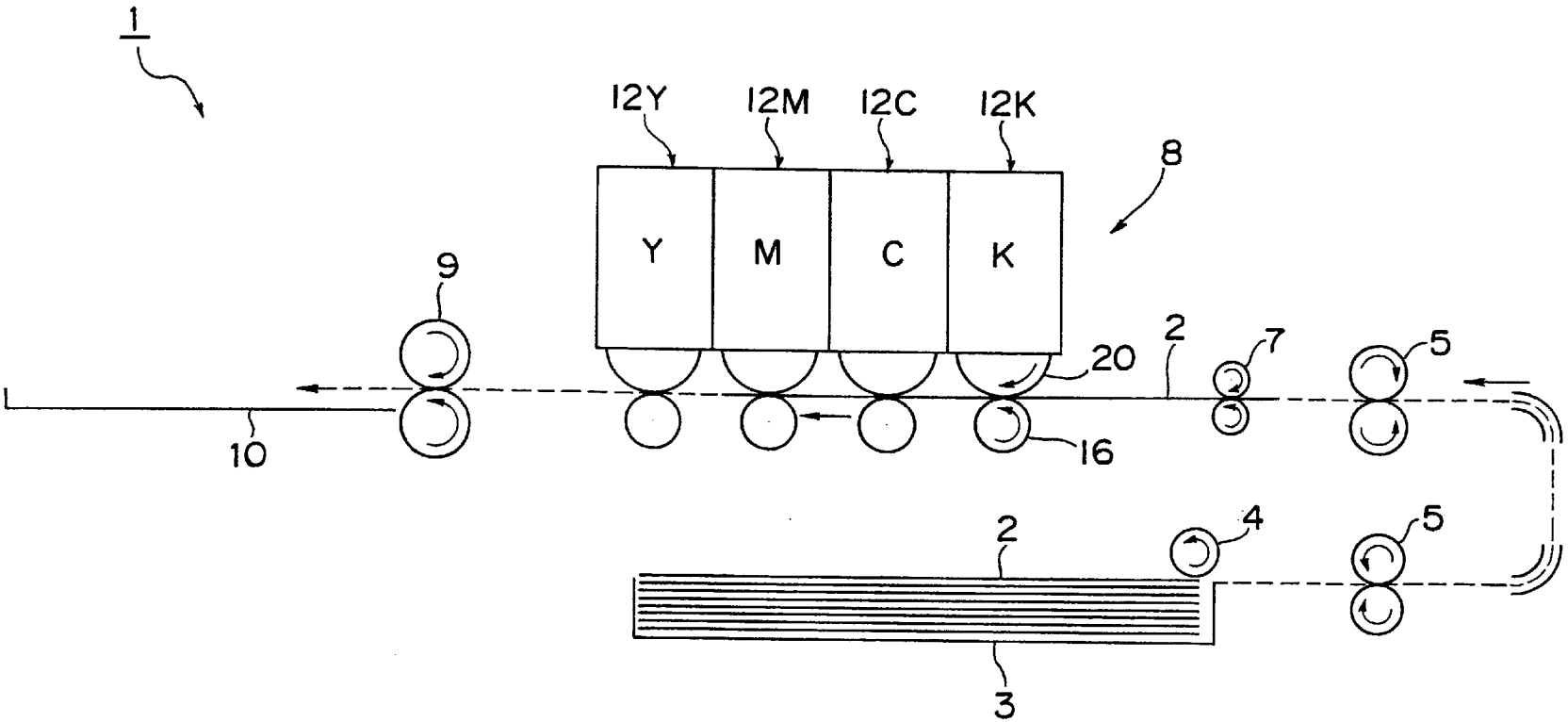
FIG. 1 is a schematic diagram of a color image forming device according to the present invention.

With reference to the drawings, a preferred embodiment of the present invention will be described hereinafter. FIG. 1 is a schematic diagram of a color image forming device 1 according to the present invention. The image forming device 1 includes a sheet tray 3 for accommodating one or more recording media 2 such as papers or resin films. A top sheet of the recording media 2 in the supply tray 3 is in contact with a feed roller 4 located above the sheet tray 3 so that the feed roller 4 rotates in the direction indicated by the arrow and feeds the top sheet from the sheet tray 3 to a transport path indicated by a dotted line. Also, one or more pairs (two pairs in this embodiment) of transport rollers 5 are provided on a downstream side of the feed roller 4 with regard to a sheet feeding direction so that they rotate in the direction indicated by the arrow to transport the recording medium 2 along the transport path to an image forming unit 8.

In the vicinity of the image forming unit 8 is provided a pair of timing rollers 7, which rotate in the direction indicated by the arrow in response to an image signal to feed the recording medium 2 to the image forming unit 8.

A pair of fixing rollers 9 and then a sheet discharge tray 10 are provided on a downstream side of the image forming unit 8 with respect to a sheet transporting direction. Accordingly, after the recording medium 2 moves past the image forming unit 8, where an ink is deposited on the recording medium 2 as will be described below, the fixing rollers 9 apply heat to the recording medium 2, which allows the ink to be dried and fixed on the recording medium 2, and rotate to discharge the recording medium 2 in the sheet discharge tray 10. It will be understood that the fixing rollers 9 may not be provided if the ink has an improved fixability against the recording medium 2.

The image forming unit 8 comprises four printing elements 12 (12K, 12C, 12M, 12Y) for black, cyan, magenta, and yellow inks, respectively, arranged along the sheet transporting direction in this order. Also, as transferring device, four transfer rollers 16 are mounted for rotation adjacent to respective image bearing members 20 to form a nip region therewith, allowing color ink born on each image bearing member 20 to be transferred onto a recording medium 2 in the nip region. Although in this embodiment four printing elements 12K, 12C, 12M, 12Y are arranged in this order along the transporting direction of the recording medium 2, this arrangement is not restrictive of the present invention.

With the image forming device 1 so constructed, a top sheet of the recording media 2 is fed by the feed roller 4 and transported by the transport rollers 5 and then timing rollers 7 to the image forming unit 8. The image forming unit 8 supplies the recording medium 2 with color inks one by one so that the color inks are superimposed one on top the other, allowing a color image to be formed on the recording medium 2.

The recording medium 2 is then transported to the nipping region of the fixing rollers 9 where the color inks superimposed one on top the other are fixed permanently to the recording medium 2. Finally, the recording medium 2 is discharged into the sheet discharge tray 10.

Figure 2:
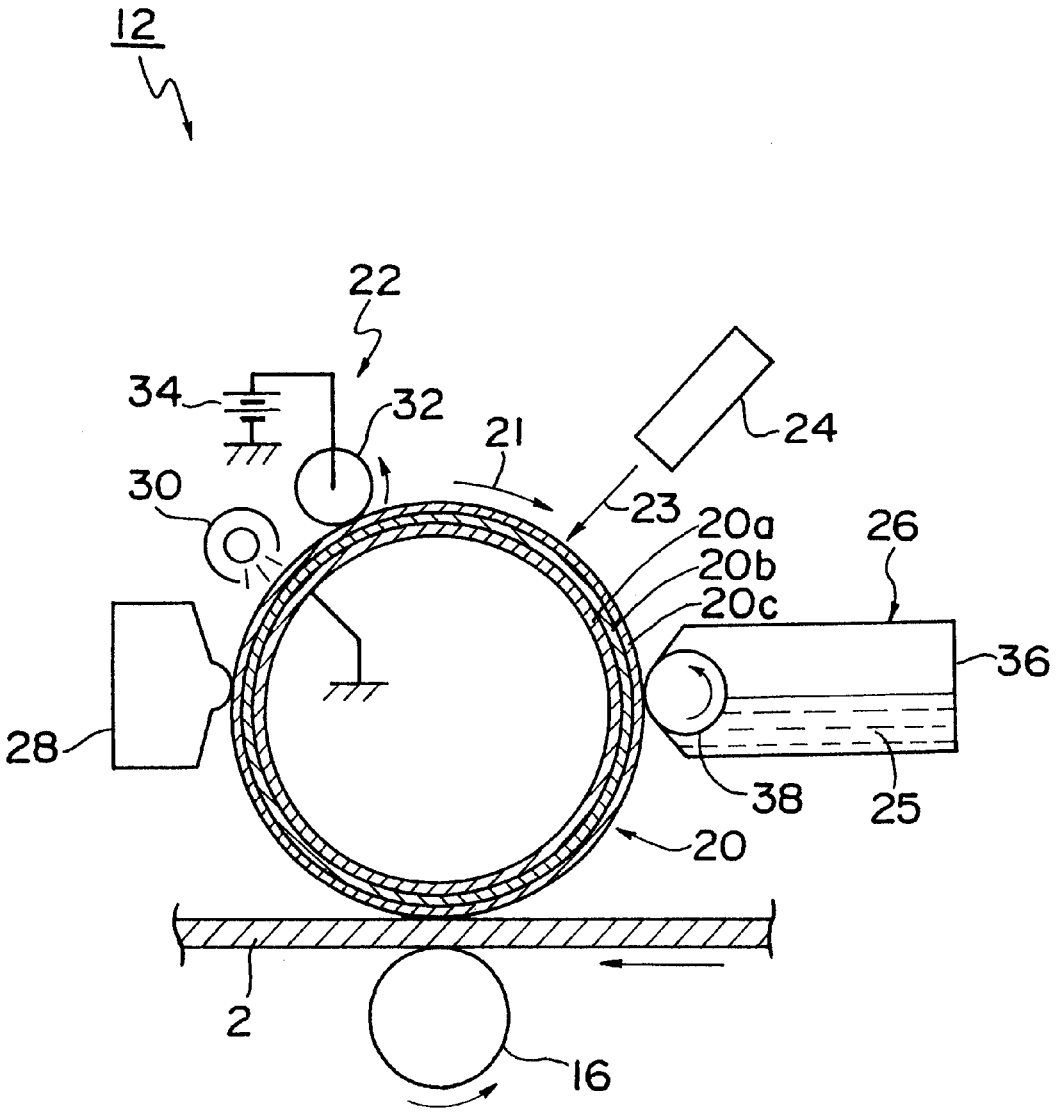
FIG. 2 is a schematic cross sectional diagram of each printing element used in the color image forming device according to the present invention.

FIG. 2 is a schematic diagram of each printing element 12 shown in FIG. 1. The printing element 12 comprises the image bearing member 20, which includes a body 20*a* in the form of roller or cylinder made of metal such as aluminum, a ferroelectric layer 20*b* provided on the outer peripheral surface of the body 20*a*, and an overcoat layer 20*c* provided on the outer peripheral surface of the ferroelectric layer 20*b*. In one embodiment, aluminum in the form of cylinder with an internal diameter of 30 mm and a thickness of 2 mm, PLZT (plumbum lanthanate zirconate titanate) with a thickness of 5 $\mu$m is used for the layer 20*b*, and fluorine-containing material (PVDF/TeEF) with a thickness of 0.2 $\mu$m are used for the body 20*a*, the ferroelectric layer 20*b* and the overcoat layer 20*c*, respectively. The image bearing member 20 is drivingly connected with a motor not shown so that they can be rotated in the direction indicated by the arrow 21. Around the image bearing member 20, a voltage applying device 22, a latent image forming device or an exposing device 24, a developing device 26, the transfer roller 16, a cleaning device 28, and an erasing device 30 are positioned in this order along the rotational direction 21 of the image bearing member 20.

The voltage applying device 22 is used for polarizing uniformly the ferroelectric layer 20*b* of the image bearing member 20. This process is referred to as poling. The exposing device 24 is used for emitting light 23 selectively onto the image bearing member 20 having the polarized ferroelectric layer 20*b* in response to image information, to form a latent image on the image bearing member 20. The developing device 28 is used for providing the image bearing member 20 with water-based ink 25 to visualize the latent image. The cleaning device 28 is used for removing residual ink from each incremental portion of the image bearing member 20 that has moved past the nip region. The erasing device 30 includes a heat lamp for heating the image bearing member 20 to erase the latent image in the ferroelectric layer 20*b*.

More specifically, the voltage applying device 22 includes an electrically conductive roller 32, which is in contact with the outer peripheral surface of the image bearing member 20 and is mounted for rotation in the direction shown by the arrow. The electrically conductive roller 32 is connected with a bias power supply 34 for applying the roller 32 with a predetermined voltage (positive polarity in this embodiment). Although the body 20*a* of the image bearing member 20 is grounded, it may be applied with a bias voltage. In this case, the ferroelctric layer 20*b* of the image bearing member 20 is applied with a voltage corresponding to the difference in voltage between the one applied by the bias power supply 34 to the outer surface of the image bearing member 20 and the one to the body 20*a*.

The developing device 26 of each image bearing member 20 includes an ink reservoir 36 for accommodating corresponding color ink 25, and a developing roller 38 drivingly connected with a motor not shown so that it can be rotated in the direction indicated by the arrow. The developing roller 38 is positioned so that its portion is located under the ink surface. Accordingly, the rotation of the developing roller 38 causes color ink 25 to be born on each incremental peripheral portion of the developing roller 38 and carried to the opposing region between the developing roller 38 and the image bearing member 20, where the ink 25 is transferred onto the latent image portion of the image bearing member 20.

Figure 3A:
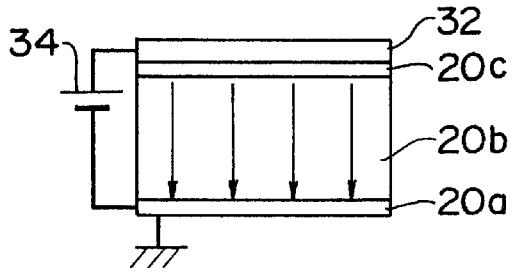
FIGS. 3A–3F are schematic diagrams showing the steps of forming an image.
Figure 3B:
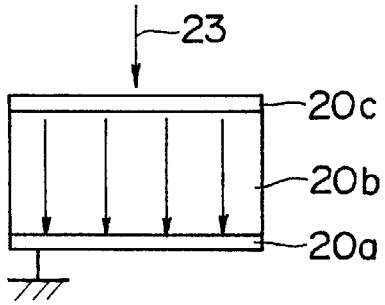
Figure 3C:
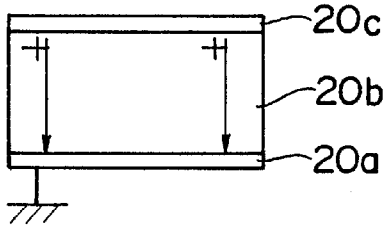
Figure 3D:
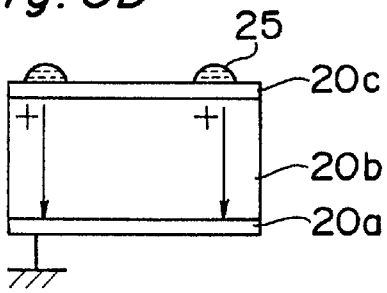
Figure 3E:
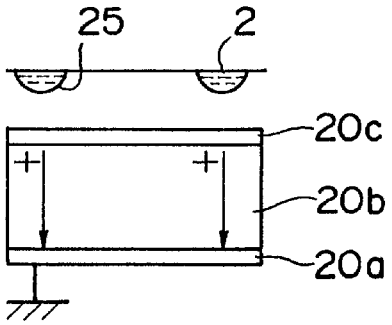

Referring to FIGS. 2 and 3A–3F, in the image forming operation of the printing element 12 so constructed, the image bearing member 20 is rotated in the direction shown by the arrow 21. The ferroelectric layer 20*b* of the image bearing member 20 is polarized uniformly by the voltage applying device 22 (FIG. 3A). Note that, in FIGS. 3A–3E, the arrows in the ferroelectric layer 20*b* indicate that the regions corresponding to respective arrows are polarized. The ferroelectric layer 20*b* is then exposed to light 23 selectively projected from the exposing device 24 in response to image information (FIG. 3B). More specifically, portions of the polarized ferroelectric layer 20*b* are exposed to light so that they are heated to more than Curie point temperature to thereby be depolarized (FIG. 3C). In the opposing region between the image bearing member 20 and the developing roller 38 of the developing device 26, the ink 25 is transferred onto the portions which are not depolarized (i.e., latent image portions) (due to electrostatic attraction generated between electric charges of the latent image (positive polarity) and inductive charges induced in the ink), allowing an ink image to be formed (FIG. 3D). The ink image is transported by the rotation of the image bearing member 20 to the opposing region between the image bearing member 20 and the transfer roller 16, where it is transferred onto the recording medium 2 moving through the opposing region (FIG. 3E).

Figure 3F:
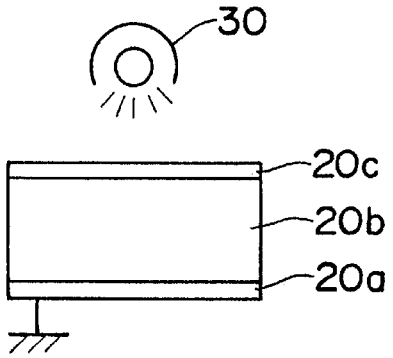

The residual ink, which has not been transferred to the recording medium 2 in the opposing region between the transfer roller 16 and the image bearing member 2, is removed by the cleaning device 28 from the outer peripheral surface of the image bearing member 20. Also, the latent image in the ferroelectric layer 20*b* of the image bearing member 20 is heated to more than Curie point temperature by the erasing device 30 to thereby be erased (FIG. 3F). The printing element 12 is prepared for the next image forming.

As is well known to those skilled in the art, any suitable methods can be used other than that described above, for forming a latent image in the ferroelectric layer. As an example, there is a method in which the ferroelectric layer is polarized uniformly and then applied with a voltage so that polarization is partially reversed and thereby a latent image is formed.

As ferroelectric materials to be used for a ferroelectric layer 20*b*, either inorganic or organic materials may be used. Specifically, as the inorganic materials, PLZT, $SrBi_2Ta_2O_9$, PZT, $BaTiO_3$, $LiNbO_3$, $PbTiO_3$, $KNbO_3$, $KTaO_3$, $PbNb_2O_6$, $SrTiO_3$, $LiTaO_3$, $Sr_{1-x}Ba_xNb_2O_6$, $Pb_{1-x}La_xNb_2O_6$, and $BiNaTiO_6$ are exemplified. As the organic materials, vinylidene fluoride-tetrafluoroethylene copolymer, poly (vinylidene cyanide), vinylidene cyanide-vinyl acetate copolymer, poly(vinylidene fluoride), and vinylidene fluoride-trifluoroethylene copolymer may be used. Further, composite materials composed of the inorganic and organic materials may also be used.

The overcoat layer 20*c* is provided for controlling the durability of the image bearing member 20 and the wetting of the ink onto the image bearing member 20. The material used for the overcoat layer 20*c* is selected, which has a desired electrical insulating property for enhancing polarization-maintaining capability of the ferroelectric layer 20*b*, a surface tension value allowing the ink to easily wet on the layer 20*c*, and relatively high wear resistance. For example, as resins, epoxy resin, polyurethane resin, polyamide resin, polycarbonate resin and the like are exemplified. As ceramics, $Al_2O_3$, SiC, $BaTiO_3$ and the like are exemplified. As glasses, element-containing glass, hydrogen-containing glass, chloride-containing glass, fluoride-containing glass and the like are exemplified.

As coloring materials to be used for the water-based ink 25, either dyes or pigments may be employed. They are dispersed in an aqueous medium in the form of colloidal particles with a known dispersing device. As the dyes, conventionally known dyes may be used, and acidic dyes, basic dyes, disperse dyes and the like are exemplified. As the pigments, azo pigments such as azo lake pigments, insoluble azo pigments and condensed azo pigments, polycyclic pigments such as phthalocyanine, perylene, perynone, anthraquinone, quinacridone and dioxazine are exemplified. However, considering the durability, pigments are more preferable.

The inventor of the present invention has found that, through the examples described hereinafter, problems such as bleeding between the color inks, trapping failure, or backtrapping are reduced, by decreasing the surface tension values of color inks 25 used in respective printing elements 12 in order of use along the transporting direction of the recording medium 2, in other words, the surface tension of the first ink is set higher than that of the second ink. The inventor has also found that it is preferable to set the surface tension difference between each color ink 25 equal to or less than 15 dyne/cm.

Although water-soluble organic solvent, surfactant, or resin can be used for modifying the surface tension, surfactant or resin is preferably used.

Also, it is preferable to increase thixotropic index, i.e., to reduce ink fluidity of the first ink. This is because, when ink is transferred onto the recording medium 2 and then shear stress in the ink is relieved, ink structural viscosity in the ink is generated and ink condensation is increased, which results in lower backtrapping property. The thixotropic index is the ratio of a viscosity coefficient measured by a B-type viscometer with a rotor at 30 revolutions per hour to a viscosity coefficient at 60 revolutions per hour. The thixoropic index is preferably equal to or more than 1.2, and more preferably equal to or more than 1.4. In the case of a thixotropic index of less than 1.2, backtrapping may occur when the difference in surface tension values between the first and second inks is relatively small.

On the other hand, it is preferable to increase ink fluidity of the second ink, i.e., to set its thixotropic index equal to or less than 1.2 to enhance trapping property.

As thixotropic modifiers, those modifiers that are conventionally known may be used. As inorganic thixotropic modifiers, silicates, montmorillonite and the like are exemplified. As organic thixotropic modifiers, cellulose derivatives such as methyl cellulose; protein based materials such as casein; alginic acid based materials such as sodium alginate; polyvinyl based materials such as poly(vinyl alcohol); polyacrylic acid based materials such as poly (sodium acrylate); polyether based materials such as Pluronic polyethers; maleic anhydride copolymer systems such as vinyl methyl ether-maleic anhydride copolymer are exemplified.

Discussions will be made to examples prepared by the inventor of the present invention.

In examples 1–6 and 8, and comparative examples 1 and 2, images were formed on a plain paper using an image forming device X, in which two printing elements shown in FIG. 2 are positioned side by side. In example 7, image was formed on a plain paper using an image forming device Y, in which the ferroelectric layer of the image bearing member is replaced by a conventionally well known photosensitive layer. (e.g., selenium-containing, amorphous silicon, or OPC photosensitive layer). The printing element of the image forming device Y is similar to the printing element shown in FIG. 2 except that charging and discharging methods with regard to the latent image forming layer or photosensitive layer are different. Therefore, the printing element of the image forming device Y is not shown herein. In these examples, water-based inks A–H described below were used.

The image in each example was formed with linear lines at intervals of 10 mm along the paper transporting direction so that the second ink was superimposed partially on the first ink.

In examples 1–8, the surface tension of the first ink was set higher than that of the second ink. In comparative example 1, the surface tension of the first ink was set equal to that of the second ink. In comparative example 2, the surface tension of the first ink was set lower that of the second ink.

The conditions and results of the examples 1–8 and comparative examples 1 and 2 are shown in Table 1. The items "Bleeding", "Trapping" and "Backtrapping" in the diagram are evaluated as follows:

Evaluation Items (a) Bleeding

The resultant image was observed through a magnifier lens and it was checked visually whether there was any bleeding at the boundary between the first ink and the second ink.

A: No bleeding was observed.

B: A small amount of bleeding was observed.

C: A large amount of bleeding was observed.

(b) Trapping

The resultant image was observed through a magnifier lens and the degree to which the second ink was transferred onto the first ink was visually checked.

A: The second ink was uniformly transferred onto the first ink.

B: A small amount of crawling was observed.

C: A large amount of crawling was observed.

(c) Backtrapping

It was visually checked whether the first ink on the paper was offset onto the outer peripheral surface of the image bearing member bearing the second ink.

A: No offset was observed.

B: A small amount of offset was observed.

C: A large amount of offset was observed.

Water-based inks used in examples and methods of fabricating these inks are shown below.

Water-Based Ink A

A mixture of 100 parts by weight of glass beads (having a diameter of 2 mm), 20 parts by weight of carbon black (under the trade name of Printex-35 available from Degussa-Huls AG Geschafsbereich Dental), 22.5 parts by weight of BYK-190, and 57.5 parts by weight of distilled water were prepared in a mayonnaise bottle with a volume of 200 ml. The mixture was kneaded by a paint shaker for 60 minutes. 10 parts by weight of glycerin and some water were added to 25 parts by weight of dispersion element obtained from the kneaded mixture, so that all the ingredients added up to 100 parts by weight. Finally, the ingredients were mixed for 10 minutes to obtain black ink. The ink had a surface tension of 48 dyne/cm and a thixotropic index of 1.1.

Water-Based Ink B

A mixture of 100 parts by weight of glass beads (having a diameter of 2 mm), 20 parts by weight of carbon black (under the trade name of Printex-35 available from Degussa-Huls AG Geschafsbereich Dental), 22.5 parts by weight of BYK-190, and 57.5 parts by weight of distilled water were prepared in a mayonnaise bottle with a volume of 200 ml. The mixture was kneaded by a paint shaker for 60 minutes. 3 part by weight of polyvinylpyrrolidone (having a molecular mass of 50000) as thixotropic modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain black ink. The ink had a surface tension of 48 dyne/cm and a thixotropic index of 1.3.

Water-Based Ink C

A mixture of 100 parts by weight of glass beads (having a diameter of 2 mm), 20 parts by weight of chromophtal yellow (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 0.2 parts by weight of SMA 1440 (manufactured by ATOFINA Chemicals, Inc.) as surface tension modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 40 dyne/cm and a thixotropic index of 1.1.

Water-Based Ink D

A mixture of 100 parts by weight of glass beads (having a diameter of 2 mm), 20 parts by weight of chromophtal yellow (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 10 parts by weight of methanol as surface tension modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 42 dyne/cm and a thixotropic index of 1.1.

Water-Based Ink E

A mixture of 100 parts by weight of glass beads (having a diameter of 2 mm), 20 parts by weight of chromophtal yellow (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 25 parts by weight of methanol as surface tension modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 30 dyne/cm and a thixotropic index of 1.1.

Water-Based Ink F

A mixture of 100 parts by weight of glass beads (having a diameter of 2 mm), 20 parts by weight of chromophtal yellow (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 25 parts by weight of methanol as surface tension modifier, 5 part by weight of polyvinylpyrrolidone (having a molecular mass of 50000) as thixotropic modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 30 dyne/cm and a thixotropic index of 1.3.

Water-Based Ink G

A mixture of 100 parts by weight of glass beads (having a diameter of 2 mm), 20 parts by weight of cyanine blue (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 0.5 parts by weight of SMA 1440 (manufactured by ATOFINA Chemicals, Inc.) as surface tension modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 35 dyne/cm and a thixotropic index of 1.1.

Water-Based Ink H

A mixture of 100 parts by weight of glass beads (having a diameter of 2 mm), 20 parts by weight of cyanine blue (manufactured by Dainichiseika Chemicals, Inc.), 22.5 parts by weight of BYK-190, and 57.5 parts by weight of distilled water were prepared in a mayonnaise bottle with a volume of 200 ml. The mixture was kneaded by a paint shaker for 60 minutes. 0.5 parts by weight of SMA 1440 (manufactured by ATOFINA Chemicals, Inc.) as surface tension modifier, 5 part by weight of polyvinylpyrrolidone (having a molecular mass of 50000) as thixotropic modifier, 10 parts by weight of glycerin, and some water were added to 25 parts by weight of dispersion element obtained from the kneaded mixture, so that all the ingredients added up to 100 parts by weight. Finally, the ingredients were mixed for 10 minutes to obtain yellow ink. The ink had a surface tension of 35 dyne/cm and a thixotropic index of 1.3.

TABLE 1

| | | Ex. 1 | Ex. 2 | Ex. 3 | Ex. 4 | Ex. 5 |
|---|---|---|---|---|---|---|
| First Ink | Ink No. | A | B | B | G | H |
| | Surface Tension | 48 | 48 | 48 | 35 | 35 |
| | Surface Tension Modifier | — | — | — | SMA1440 | SMA1440 |
| | Thixotropic Index | 1.1 | 1.3 | 1.3 | 1.1 | 1.3 |
| | Thixotropic Modifier | — | polyvinyl pyrrolidone | polyvinyl pyrrolidone | — | polyvinyl pyrrolidone |
| Second Ink | Ink No. | C | C | D | E | F |
| | Surface Tension | 40 | 40 | 42 | 30 | 30 |
| | Surface Tension Modifier | SMA1440 | SMA1440 | methanol | methanol | SMA1440 |
| | Thixotropic Index | 1.1 | 1.1 | 1.1 | 1.1 | 1.3 |
| | Thixotropic Modifier | — | — | — | — | polyvinyl pyrrolidine |
| Evaluation Items | | | | | | |
| Bleeding | | A | A | A | A | A |
| Trapping | | A | A | A | A | A |
| Backtrapping | | A | A | A | A | A |
| Image Forming Device | | X | X | X | X | X |

| | | Ex. 6 | Ex. 7 | Ex. 8 | Com. Ex. 1 | Com. Ex. 2 |
|---|---|---|---|---|---|---|
| First Ink | Ink No. | B | A | C | D | A |
| | Surface Tension | 48 | 48 | 35 | 42 | 48 |
| | Surface Tension Modifier | — | — | SMA1440 | methanol | — |
| | Thixotropic Index | 1.3 | 1.1 | 1.1 | 1.1 | 1.1 |
| | Thixotropic Modifier | polyvinyl pyrrolidone | — | — | — | — |
| Second Ink | Ink No. | C | F | G | B | G |
| | Surface Tension | 40 | 30 | 35 | 48 | 35 |
| | Surface Tension Modifier | SMA1440 | methanol | SMA1440 | — | SMA1440 |
| | Thixotropic Index | 1.1 | 1.1 | 1.1 | 1.3 | 1.1 |
| | Thixotropic Modifier | — | — | — | polyvinyl pyrrolidone | — |

TABLE 1-continued

| Evaluation Items | | | | | |
|---|---|---|---|---|---|
| Bleeding | A | A | B | A | A |
| Trapping | B | A | A | C | C |
| Backtrapping | A | A | A | B | C |
| Image Forming Device | X | Y | X | X | X |

Results

As shown in Table 1, in examples 1–8 in which the surface tension of the first ink were higher than that of the second ink, low bleeding property, high trapping property, low backtrapping property were generally obtained.

However, example 6 had a lower trapping property than other examples because the fluidity of the second ink in example 6 was not high enough, i.e., its thixotropic index was higher than 1.2, although the difference in the surface tension values was appropriate. Contrary to this, example 6 had a suitably low backtrapping property because the fluidity of the first ink in the example was high enough, i.e., its thixotropic index was higher than 1.2.

Also, it was not preferable to set the surface tension difference more than 15 dyne/cm, because bleeding occurred as shown in example 8. Furthermore, in case where the surface tension of the first ink was equal to or lower than that of the second ink, the second ink was not trapped on the first ink appropriately, and the first ink was trapped back on the outer surface of the image bearing member bearing the second ink. It is noted that, in this case, bleeding did not occur because of a relatively small difference in the surface tension values between the first and second inks. In example 4, although the first ink had a relatively low thixotropic index of 1.1, a suitably low backtrapping property was obtained. This index is to be considered as a value that is near lower limit to avoid backtrapping.

Accordingly, by setting the surface tension of the first ink higher than that of the second ink, preferably the difference in the surface tension values equal to or less than 15 dyne/cm, the resultant image can obtain lower bleeding and backtrapping properties, and higher trapping property.

There has been described in detail for a preferred embodiment of the color image forming apparatus according to the present invention, but it is to be understood that various modifications can be effected within the spirit and scope of the invention.

For example, although in the previous embodiment a material such as ferroelectric or photosensitive material is used for forming latent image on the image bearing member, it may be replaced by any other suitable material such as photoisomerizable material.

Also, although in the previous embodiment color inks 25 are transferred from the image bearing members 20 directly onto the recording medium 2 where the inks 25 are superimposed one on top the other, the color inks 25 may be first superimposed one on top the other on an intermediate ink receptive blanket, and then the superimposed inks 25 be transferred onto the recording medium 2.

Furthermore, although in the previous embodiment the printing elements 12 are arranged in tandem, a center drum construction may be employed instead, where each color ink image is separately formed on one image bearing member and then is transferred onto the recording medium.

What is claimed is:

1. An image forming apparatus, comprising:

(a) first and second image bearing members;

(b) a first latent image forming device for forming a first latent image on the first image bearing member and a second latent image forming device for forming a second latent image on the second image bearing member;

(c) a first developing device for developing said first latent image with first ink to form a first ink image, and a second developing device for developing said second latent image with second ink to form a second ink image; and (d) a first transferring device which transfers said first ink image onto a transfer member and a second transferring device which subsequently transfers said second ink image onto said transfer member, wherein the surface tension of said first ink is higher than that of said second ink.

2. The image forming apparatus in accordance with claim 1, wherein each of said first and second image bearing members includes a ferroelectric layer for forming a latent image therein.

3. The image forming apparatus in accordance with claim 1, wherein said first and second inks are water-based inks.

4. The image forming apparatus in accordance with claim 1, wherein the surface tension difference between said first and second inks is equal to or less than 15 dyne/cm.

5. The image forming apparatus in accordance with claim 1, wherein the thixotropic index of the first ink is higher than that of the second ink.

6. The image forming apparatus in accordance with claim 5, wherein the thixotropic index of the first ink is equal to or more than 1.2.

7. The image forming apparatus in accordance with claim 6, wherein the thixotropic index of the second ink is equal to or less than 1.2.

8. The image forming apparatus in accordance with claim 5, wherein said first and second inks are water-based inks.

9. The image forming apparatus in accordance with claim 1, wherein thixotropic indices of said first and second inks are equal to or more than 1.1.

10. The image forming apparatus in accordance with claim 9, wherein said first and second inks are water-based inks.

11. The image forming apparatus in accordance with claim 1, wherein the thixotropic index of the first ink is equal to or more than 1.2 and higher than that of the second ink.

12. An image forming method, comprising the steps of:

(a) forming first and second latent images;

(b) developing the first latent image with first ink to form a first ink image, and developing the second latent image with second ink to form a second ink image; and (c) transferring said first ink image onto a transfer member and then said second ink image onto said transfer member, wherein the surface tension of said first ink is higher than that of said second ink.

13. The image forming method in accordance with claim 12, wherein said first and second inks are water-based inks.

14. The image forming method in accordance with claim 12, wherein the surface tension difference between said first and second inks is equal to or less than 15 dyne/cm.

15. The image forming method in accordance with claim 12, wherein the thixotropic index of the first ink is equal to or more than 1.2 and higher than that of the second ink.

16. An image forming apparatus, comprising:

a first image forming unit which includes a first image bearing member; a first latent image forming device for forming a latent image on said first image bearing member; a first developing device for developing the latent image formed on said first image bearing member with first ink to form a first ink image; and a first transferring device for transferring said first ink image onto a transfer member; and a second image forming unit which includes a second image bearing member; a second latent image forming device for forming a latent image on said second image bearing member; a second developing device for developing the latent image formed on said second image bearing member with second ink to form a second ink image; and a second transferring device for transferring said second ink image onto said transfer member onto which said first ink image has been transferred, wherein the surface tension of said first ink is higher than that of said second ink.

17. The image forming apparatus in accordance with claim 16, wherein each of said first and second image bearing members includes a ferroelectric layer for forming a latent image therein.

18. The image forming apparatus in accordance with claim 16, wherein said first and second inks are water-based inks.

19. The image forming apparatus in accordance with claim 16, wherein the surface tension difference between said first and second inks is equal to or less than 15 dyne/cm.

20. The image forming apparatus in accordance with claim 16, wherein the thixotropic index of the first ink is equal to or more than 1.2 and higher than that of the second ink.

* * * * *